US005276288A

United States Patent [19]

Erickson et al.

[11] Patent Number: 5,276,288

[45] Date of Patent: Jan. 4, 1994

[54] SHUNT TRIP SWITCH OPERATOR

[75] Inventors: William C. Erickson, Cary; James A. Erickson, Crystal Lake, both of Ill.

[73] Assignee: Boltswitch, Inc., Crystal Lake, Ill.

[21] Appl. No.: 749,680

[22] Filed: Aug. 26, 1991

[51] Int. Cl.[5] ..... H01H 5/00

[52] U.S. Cl. ..... 200/400; 200/337; 200/327; 74/469

[58] Field of Search ..... 200/400, 401, 329, 337, 200/48; 335/185, 190, 192, 64; 74/471

[56] References Cited

U.S. PATENT DOCUMENTS

| | | | |
|---|---|---|---|
| 3,522,401 | 8/1970 | Stene | 200/400 |
| 3,582,595 | 6/1971 | Stene | 200/400 |
| 4,578,551 | 3/1986 | Lin | 200/400 |
| 4,916,268 | 4/1990 | Micoud et al. | 200/400 |

*Primary Examiner*—Henry J. Recla
*Assistant Examiner*—Glenn T. Barrett
*Attorney, Agent, or Firm*—Kinzer, Plyer, Dorn, McEachran & Jambor

[57] ABSTRACT

A trip-free operating mechanism for a load break switch of the type having a fixed contact engageable by a movable contact between a fully closed position and a fully open position. The operating mechanism includes an operating lever connected to the movable contact and rotatable about a shaft to move the contact between its open and closed positions. A follower rotates with the shaft into and out of contact with the operating lever. A closing spring biases the operating lever and the follower towards each other. An opening spring drive connects to the follower to drive the follower to its switch contact open position. A first latch holds the operating lever and follower apart against the force of the closing spring when the operating lever is in its switch contact closed position. A manual and a solenoid actuated trip mechanism are provided to release the first latch to allow the closing spring to rotate the follower into engagement with the operating mechanism and to rotate the spring drive to quickly drive the operating lever to its switch contact open position. A second latch retains an operating handle in its closed position until the closing spring rotates the follower into engagement with the operating mechanism. The operating handle is nudged to fall by gravity to its switch open position when the follower rotates to its switch contact open position. The operating handle engages the follower in the switch contact open position to rotate the follower to near its switch closed position while the operating lever is latched in the switch open position. The operating lever latch may be released by rotation of the follower or by actuation of a second solenoid.

8 Claims, 5 Drawing Sheets

SHUNT TRIP SWITCH OPERATOR

BACKGROUND OF THE INVENTION

This invention relates to a new and improved trip-free operating mechanism for a load break switch and particularly to a switch operating mechanism readily adaptable to both manual and electrical tripping, including remote electrical tripping and remote closing.

Fused load break switches are frequently used in service entrance equipment and in other relatively high current applications; typically, multiple-pole switches of this kind may require interruption of currents of the order of 400 to 80,000 amperes. It is critically important that the contacts of these switches open and close rapidly to minimize arcing and thereby avoid pitting and deterioration of the switch contacts. The switches usually provide for latching of the switch contacts in the closed position. The switch blades are relatively heavy and the mechanical forces entailed in opening and closing operations are often substantial.

Other problems have been found in the use and operation of such heavy-duty switches. The forces needed to actuate the switch, both during opening and closing, are considerable because the opening and closing springs of typical operating mechanisms work against each other at times. The closing of the contacts of a switch requires rotation of the operating handle first through a limited arc in one direction and then through a greater arc in the opposite direction, thus complicating the switch closing process. In some operating mechanisms, the on-off condition of the switch contacts is indicated only by the position of the operating handle, causing uncertainty as to whether the operating mechanism is in its on, off or in its reset positions. Additional problems have arisen because the closing speed of the switch contacts is not completely independent of the speed of rotation of the operating handle. Further, the operating handle cannot be manipulated to break welds holding the switch contacts partially closed in the event the opening spring drive does not overcome the adhesions caused by such welds and leaves the contacts in an intermediate, hung-up position.

SUMMARY OF THE INVENTION

Accordingly, it is a principal object of this invention to provide a new and improved trip-free operating mechanism for a load break switch that requires a minimum force to actuate the switch, both during opening and closing sequences.

A specific object of the invention is an operating mechanism in which the closing spring initiates the opening of the switch contacts when the switch is tripped.

Another specific object of the invention is an operating mechanism in which the operating spring drive may be in-toggle, over-toggle, or just short of being in-toggle, as desired, in order to provide minimum latch pressures that must be overcome by the trip mechanism.

Another object of this invention is an operating mechanism in which the closing speed of the movable switch contacts is independent of the rotational speed of the operating handle during closing of the switch contacts.

Another specific object of this invention is an operating mechanism in which the operating handle may be used to manually force open fused switch contacts in the event the switch contacts fail to open fully after the switch is tripped.

Another object of this invention is an operating mechanism having a visual indicator which is truly representative of the actual on-off condition of the switch contacts.

Another object of this invention is an operating mechanism in which the switch contacts may be closed from a remote location after the closing drive has been energized by rotation of the operating handle.

Accordingly, the invention relates to a trip-free operating mechanism for a load break switch of the kind comprising a fixed contact engageable by a movable contact that moves between fully closed and fully open positions. The operating mechanism comprises an operating lever connected to a movable contact and rotatable about a shaft between a first position in which the movable contact is in its fully closed position and a second position in which the movable contact is in its fully open position. A follower is mounted for rotation with the shaft into and out of contact with the operating lever and is rotatable in an arc from adjacent the first position of said operating lever to adjacent the second position of said operating lever.

A closing spring biases the operating lever and the follower for rotation together toward each other. An opening spring drive means is connected to the follower. A first latch means is provided for releasably holding the operating lever and the follower apart against the biasing force of the closing spring when the opening lever is in the first position. Trip means are provided for releasing the first latch means to allow the closing spring to rotate the follower into engagement with the operating lever and to release the opening spring means to quickly drive the operating lever to its second position.

The opening spring drive means is connected to the follower in a near-toggle position when the follower is located adjacent the first position of the operating lever. The opening spring drive means is rotated upon rotation of the follower into driving engagement with the operating lever. An operating handle is mounted for rotation about the shaft between the fully closed position and the fully open position of the movable contact. A second latch means is provided to retain the operating handle in its fully closed position until the residual force in the closing spring rotates the follower into engagement with the operating lever. The operating lever is forced to its fully open position by the follower when the follower rotates to adjacent the second position of the operating lever under the influence of the opening spring drive means.

The first latch mechanism is pivotally mounted on the operating handle and is spring biased into pulling engagement with the follower when the operating handle is rotated from the fully open position to the fully closed position of the movable contact. Means associated with the operating handle engages the follower during rotation of the operating handle from the fully closed to the fully open positions of the movable contact in the event that the follower has not been rotated to adjacent said second position of said operating lever by the opening spring drive means so that the movable contact can be physically moved to its open position.

Other and further objects of the invention may be found in the following specification, claims and drawings.

DESCRIPTION OF THE PREFERRED EMBODIMENTS

Figure 2:
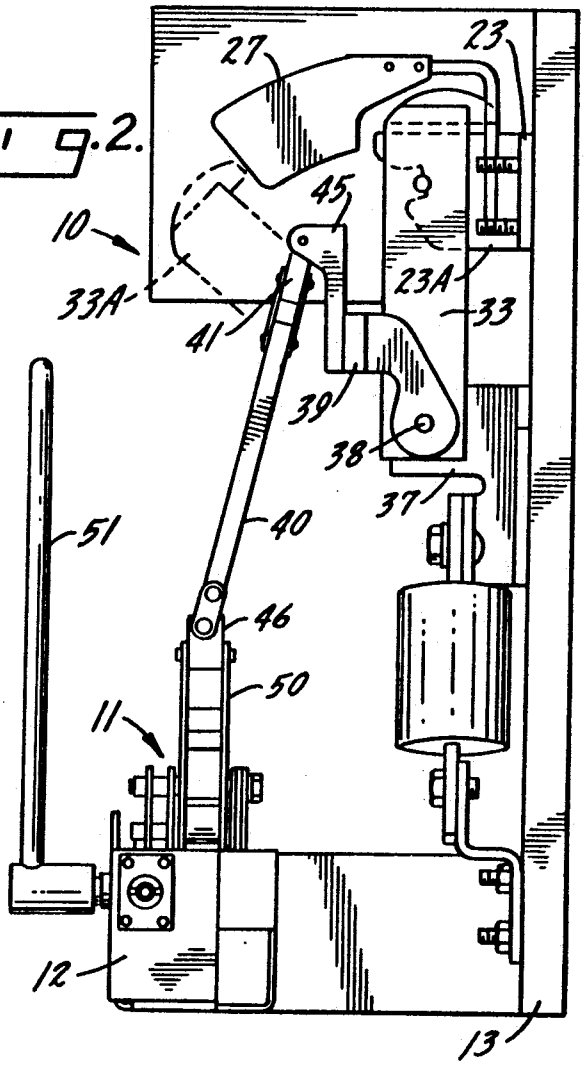
FIG. 2 is a side elevational view of the switch of FIG. 1.
Figure 1:
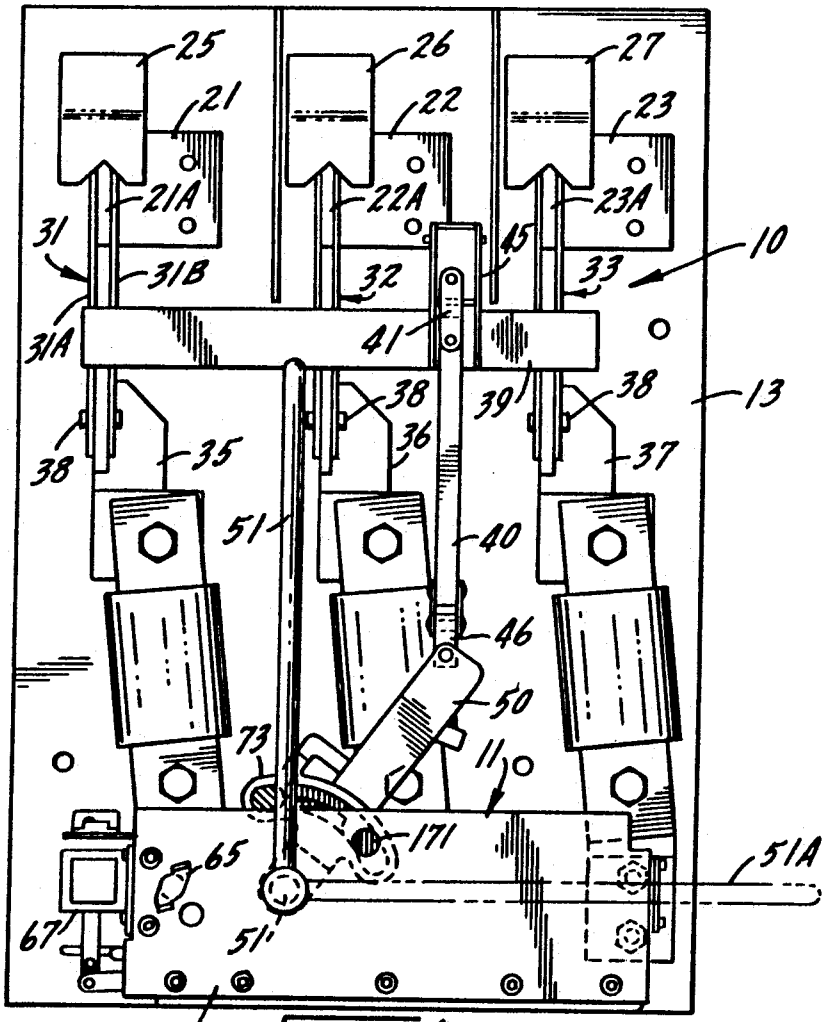
FIG. 1 is a front elevational view of a load break switch equipped with a trip-free switch operating mechanism constructed in accordance with the present invention.

FIGS. 1 and 2 illustrate a load break pressure contact switch 10, having a contact mechanism of known construction, shown in its closed condition. Switch 10 is operated by a trip-free operating mechanism 11 mounted in a housing 12 supported on a base 13 and constructed in accordance with the present invention, as described in detail hereinafter. Switch 10 includes the previously mentioned base member 13 which is fabricated from a suitable insulating material. Across the top of the base 13 there are mounted three fixed contacts 21, 22 and 23. The fixed contacts 21, 22 and 23 are provided with outwardly projecting contact blades 21A, 22A and 23A, respectively, and each may be provided with an individual terminal lug (not shown), thus affording three input terminals for each switch 10. Three arc chutes 25, 26 and 27 are mounted on fixed contacts 21, 22 and 23, respectively.

Each of the fixed contacts 21-23 is one element of a pole for switch 10. Fixed contacts 21, 22 and 23 are engageable by three movable contacts 31, 32 and 33, respectively. Each of the movable contacts of the switch comprises a pair of contact blades such as blades 31A and 31B for movable contact 31. Movable contacts 31, 32 and 33 are pivotally mounted upon three electrical connector brackets 35, 36 and 37, respectively, by means of suitable pivot members such as the bolts 38.

Switch 10 further includes an actuating bar 39 which extends transversely of the switch and is also pivotally mounted upon the three fixed contact brackets 35-37 by means of the three bolts 38. An actuator bar is connected to each of the movable contacts 31-33 by means of a connecting linkage, so that pivotal movement of the bar 39 with respect to the aligned pivot pins 38 drives the movable contacts of the switch to move pivotally in and out of engagement with fixed contacts 21-23. Switch 10 is also provided with appropriate overload fuses and electrical connectors to afford a means to complete electrical connections to the movable contacts.

Switch 10, as thus far described, corresponds in construction to the load break pressure contact switch described and claimed in U.S. Pat. No. 3,213,247. The present invention is not directed to the switch structure per se, but pertains to the operating mechanism 11 that is incorporated in the switch 10 and that is utilized to open and close the switch. The invention should not be construed as limited to the particular load break switch of U.S. Pat. No. 3,213,247, which is merely illustrative of a number of different forms of switches in which the invention may be incorporated.

The actuating bar 39 of switch 10 is connected to an operating rod 40 by means of a pivotal connection 41. More specifically, rod 40 has its upper end affixed to an upper yoke 45 and its lower end secured to a lower yoke 46. Lower yoke 46 is pivotally connected to an operating lever 50 that is part of the operating mechanism 11. In FIGS. 1 and 2, operating lever 50 is shown in its upper or closed-switch position with the manually operated handle 51 of the switch operating mechanism 11 disposed at an angle of approximately 90° counterclockwise from the horizontal (FIG. 1). When the switch 10 is tripped to its open position, handle 51 pivots from the solid line position of FIG. 1 to the dashed line position 51A. Opening of the switch is effected by lever 50, which turns in a clockwise direction and pulls drive rod 40 downwardly to pivot actuating bar 39 outwardly and away from switch base 13. This pivotal movement of bar 39 simultaneously pivots the movable contacts 31-33 outwardly from the fixed contacts 21-23, to the open position 33A shown in FIG. 2, and thus opens the switch. It should be noted that the angular extent of the arcuate movement of bar 39 does not necessarily correspond to the arcuate movement of switch contacts; in a typical instance, bar 39 may move through an arc of approximately 90° whereas the blade contacts of the switch are pivoted only through an angle of approximately 45°. However, this differential is not critical to the operation of the present invention and as a matter of design choice insofar as the construction of the switch contacts is concerned.

The number of poles in the switch 10, as well as the size of the contact elements of the switch, may be varied for different applications. However, for all switches of this general kind it is essential that the contacts separate rapidly and close rapidly in order to prevent excessive arcing, which would otherwise limit the useful life of the contacts quite severely.

The internal construction of the switch operating mechanism 11 is best shown in FIGS. 3-8 and 11 of the drawings. As shown therein, the switch operating mechanism includes the previously mentioned operating lever 50, the operating handle 51, a shaft 53, a follower 55 which is fixed to the shaft 53, a spiral-shaped closing spring 57, an opening coil spring mechanism 59, a switch closing latch 61, a switch open latch 63, a trip lever 65 for the switch closing latch, a trip solenoid 67 also for the switch closing latch, an operating handle latch 71, a target 73 and an optional switch closing solenoid 75 (FIG. 11) for the switch open latch.

The housing 12 has a front wall 81, a rear wall 83, end walls 85 and 87 and a bottom wall 89 formed of heavy gauge steel which is punched and bent to shape. The shaft 53 is journaled in bearing sleeves 91 and 93 supported in the front and rear walls. The operating lever 50 is rotatably mounted on the shaft 53 and consists of two laterally spaced apart arms 95. The follower 55 is fixed to the shaft 53 for rotation therewith and consists of laterally spaced arms 97 and 99*a* and *b* that straddle the operating lever arms 95. A cylindrical cross member 100 extends between the follower arms at the distal ends thereof and is positioned to engage the operating lever arms 95. The cross member 100 includes a sleeve 101 which extends between the follower arms 97 and 99 and a bolt 102 which extends through the arms and sleeve. Arbor plates 103 forming part of the follower 55 are positioned between the operating lever arms 95 and are fixed to the shaft 53. A post 105 of rectangular cross-section is affixed to the follower arm 99*a* and extends laterally thereof to engage a hook 107 on the switch closing latch 61. The switch closing latch 61 is pivotally mounted on the operating handle arm 109 and is biased into locking engagement with the post 105 by a spring 111. The post 105 and hook 107 of switch closing latch 61 hold the follower 55 in the switch open position shown in FIG. 3 of the drawings.

The switch closing latch 61 can be tripped by rotation of the trip lever 65. The trip lever 65 has a cam 113 at its inner end which engages a pin 115 which extends laterally from the switch closing latch 61. The switch closing latch can also be tripped by the trip solenoid 67 which, upon actuation, lifts the end of a pivotally mounted arm 117. A post 119 mounted on the arm 117 engages the switch closing latch 61 to release the latch from engagement with the post 105.

Figures 3, 5, 6:
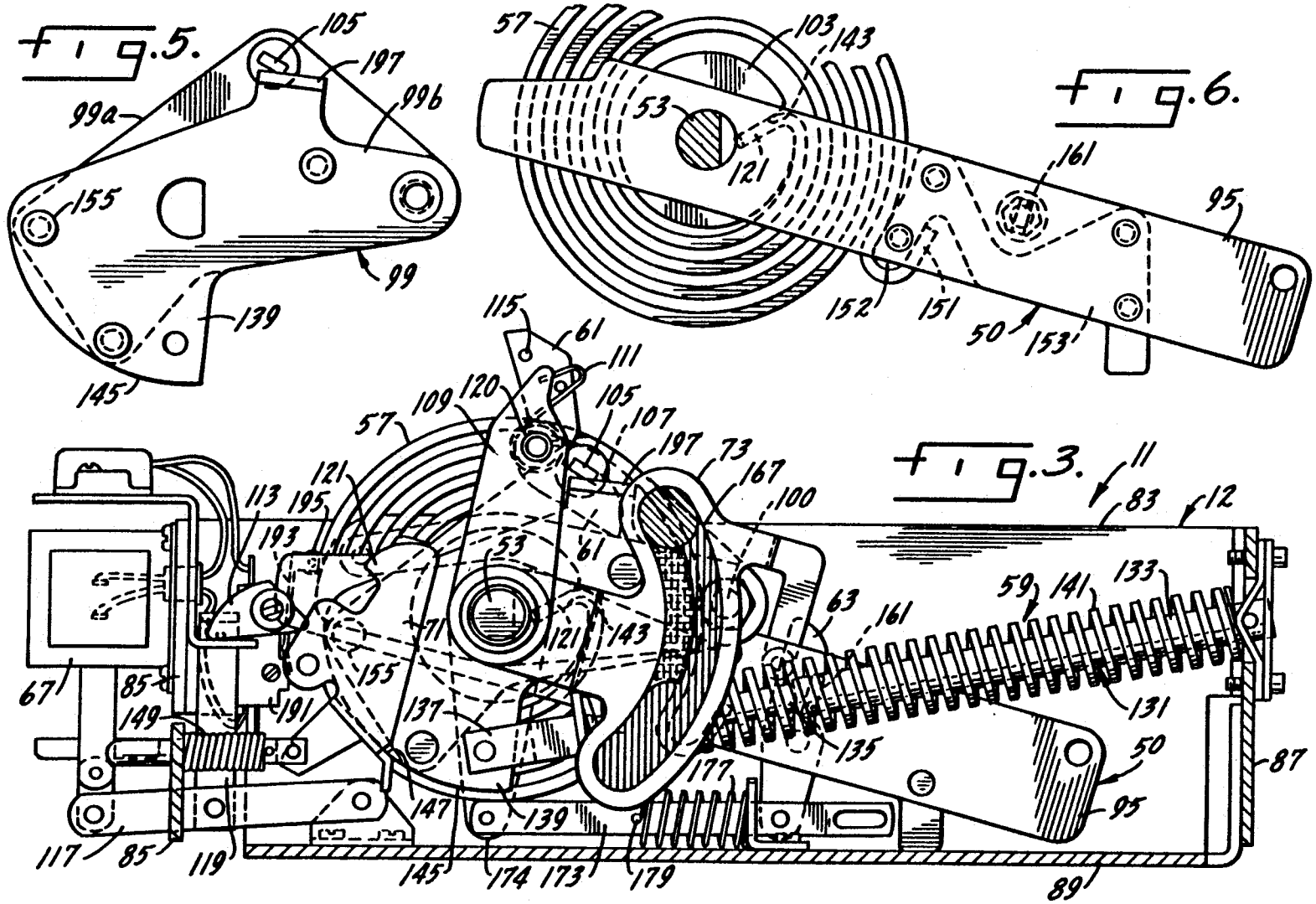
FIG. 3 is a front elevational view, with the front wall of the housing removed, of the switch operating mechanism for the switch of FIG. 1, with the switch in the open position.
FIG. 5 is an elevational view of the front portion of the follower assembly.
FIG. 6 is a front elevational view of the operating lever and closing spring.
Figure 4:
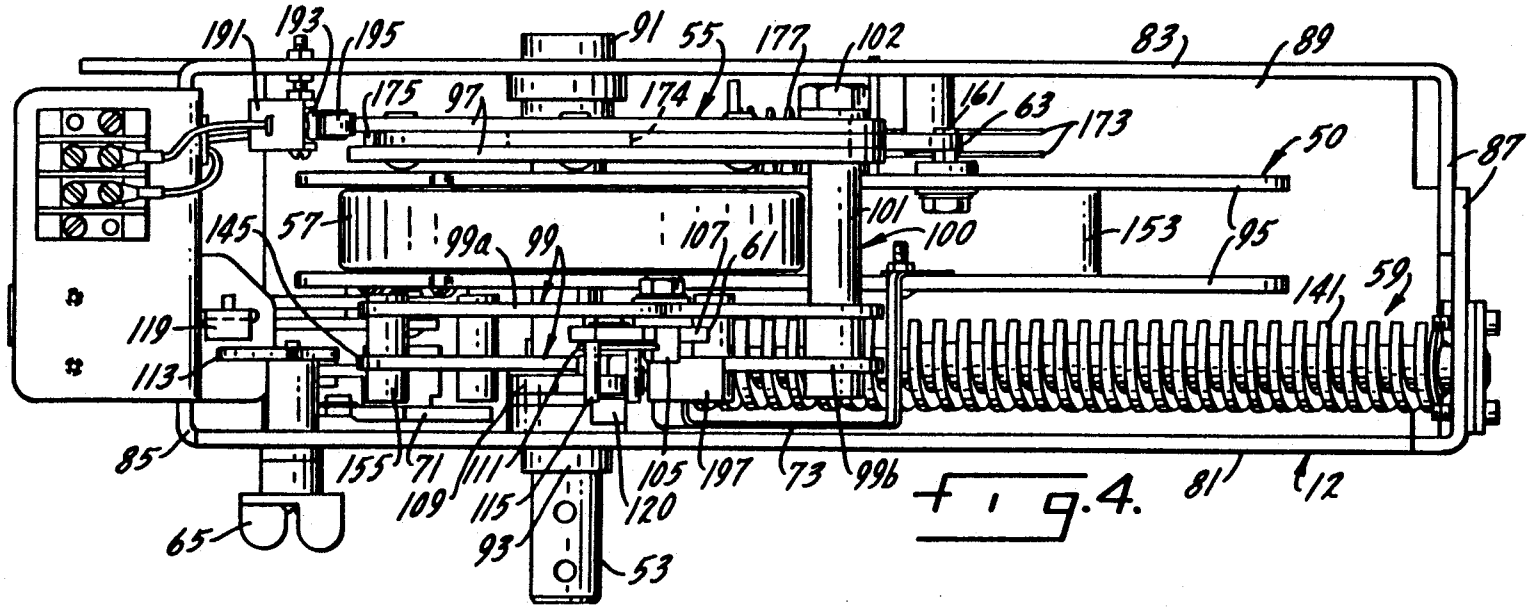
FIG. 4 is a plan view of the switch operating mechanism with the switch in the open position.
Figures 7, 8:
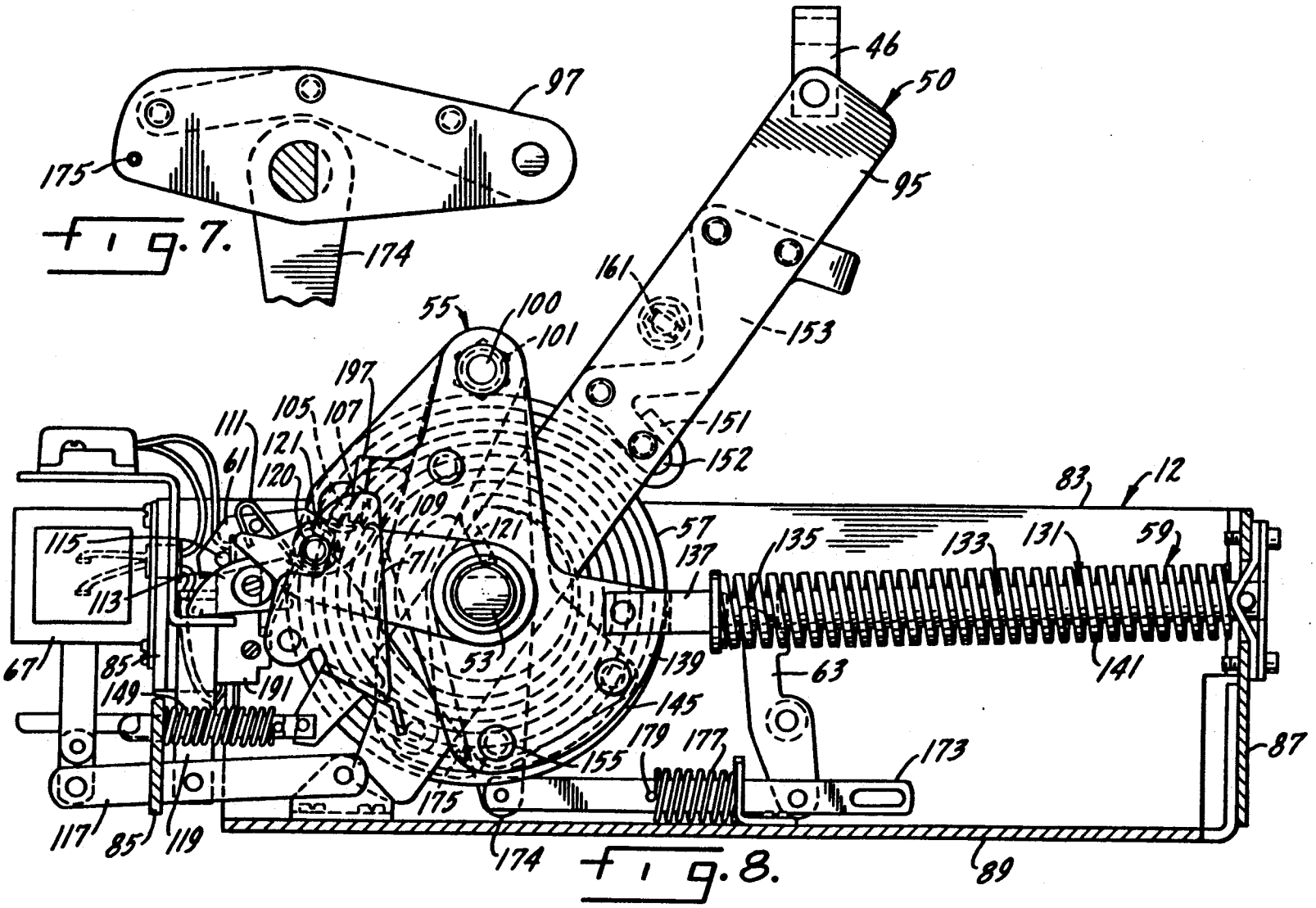
FIG. 7 is a front elevational view of the rear portion of the follower assembly.
FIG. 8 is an elevational view like FIG. 3 but with the switch in its closed condition.
Figure 9:
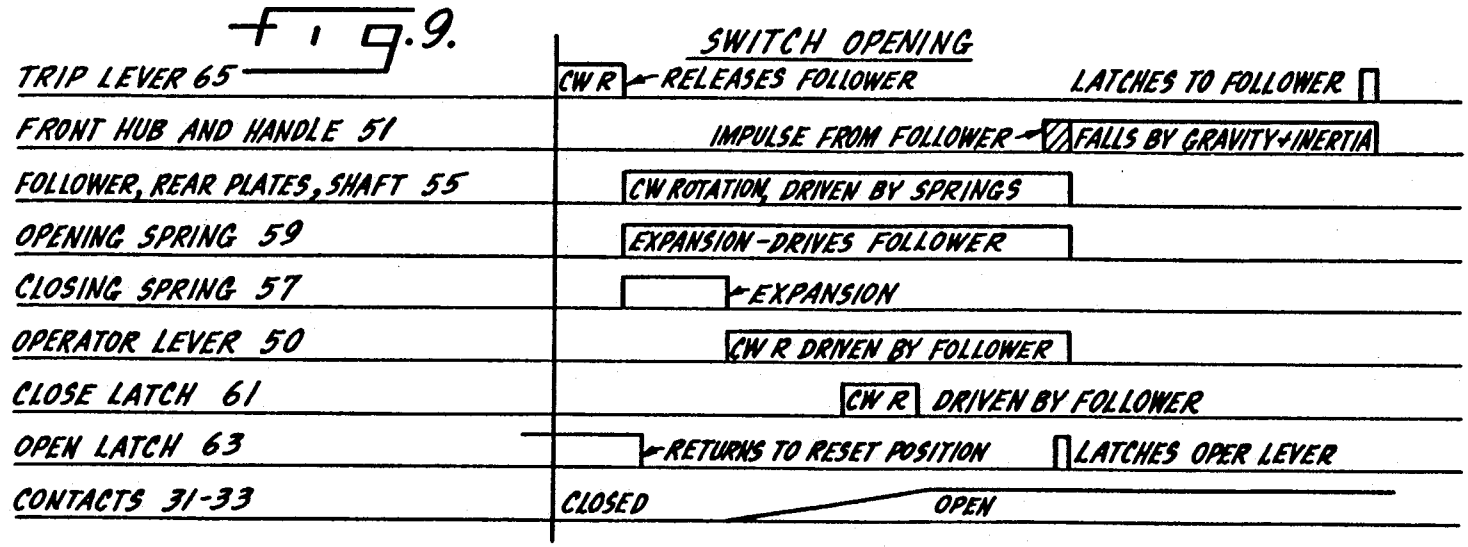
FIGS. 9 and 10 are charts of the operating sequences for certain elements of the mechanism of FIGS. 1-8 for opening and closing the switch, respectively.
Figure 10:
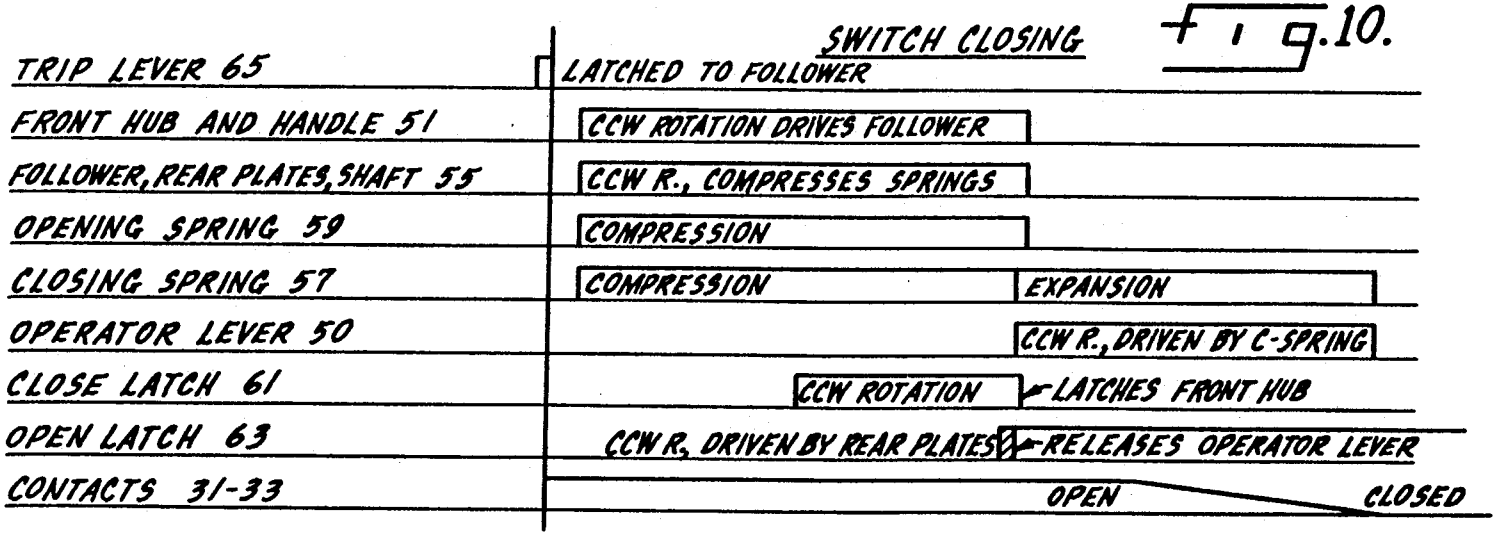

The spiral-shaped closing spring 57 has a hook 121 on its inner end anchored to a groove 143 formed in the arbor plates 103 of the follower 55. The spring 57 also has a hook 151 at its outer end which engages a leg 152 of a stack of laminated plates 153 attached between the arms 95 of the operating lever 50 as shown in FIGS. 6 and 8 of the drawings. The spring 57 biases the operating lever 50 and the follower cross member 100 toward contact with each. The operating lever is held out of contact with the follower cross member by the operating rod 40 which limits counterclockwise rotation of the operating lever 50, as shown in the drawings. When the post 105 is disengaged from the hook 107 of the switch closing latch 61 by engagement of the trip lever cam 113 with the pin 115 of the switch closing latch, the residual tension in the spiral closing spring 57 moves the follower 55 so that the follower cross member 100 moves in a clockwise direction, as viewed in FIGS. 3 and 8 of the drawings, and engages the operating lever 50 to force it to also move in a clockwise direction, as viewed in FIGS. 3 and 8 of the drawings. As the follower 55 rotates in a clockwise direction, the coiled spring opening mechanism 59 moves from a near-toggle position. The coiled spring opening mechanism 59 includes a telescoping tube and rod assembly 131 in which the tube 133 is pivotally connected to the end wall 87 of the housing and the rod 135 is connected through a yoke 137 to a lobe 139 of the follower arm 99*b*. The coiled spring 141 telescopes over the rod 135 and tube 133 so that when the telescoping assembly drops downwardly below its near-toggle position, the spring expands to urge the follower 55 to rotate in a clockwise direction, as viewed in the drawings. The coiled spring opening mechanism 59 may be in a near-toggle position, as shown, in-toggle or over-toggle as desired. The advantages of the in-toggle and over-toggle arrangements, which are not shown in the drawings, is that they require smaller latch pressures to hold the follower in the switch closed position than is required for the near-toggle position. The opening spring drive mechanism 59 can be in an over-toggle, near-toggle or in-toggle position because of the residual tension in the spiral closing spring 57 is used to initiate opening clockwise movement of the follower 55 when the latch 61 is tripped and the opening spring 141 tension is not initially used. An advantage of selecting the near-toggle position shown in the drawings is that the full expansive force of the coiled spring 141 is better utilized over the full rotational movement of the follower 55.

As the follower 55 rotates in a clockwise direction, as viewed in FIG. 3 of the drawings, a cam surface 145 on the lobe 139 formed on follower arm 99*b* (FIG. 5) engages a plate 147 formed as part of the operating handle latch 71 to rotate the latch 71 in a clockwise direction, as viewed in FIGS. 3 and 8 of the drawings, to release the hook 121 of the latch from the post 120 on the operating handle arm 109, thus freeing the operating handle 51 for rotation. The plate 147 is biased against the lobe cam 145 of the follower arm 99*b* by a spring and pin mechanism 149 mounted on the end wall 85 of the housing. As the follower 55 reaches its extreme clockwise rotational position, as viewed in FIG. 3 of the drawings, a pin 155 extending to the side of follower arm 99*b* engages the operating handle arm 109 to nudge the arm to rotate in a clockwise direction, thus causing the operating handle 51 to rotate in a clockwise direction to its fully lowered switch open position. When the operating handle 51 is fully rotated to its lowered position, the switch closing latch 61, which is carried on the operating handle arm 109, is rotated to a position in which its hook 107 engages the post 105 carried by the follower arm 99*a* to reconnect the operating arm to the follower so that counterclockwise rotation of the operating arm 51 will rotate the follower 50 back to its upright position.

The operating lever 50 carries a laterally-extending post 161 which engages the switch open latch 63 when the operating lever has rotated to its extreme clockwise position in which the spring contacts are open. This has the effect of latching the operating lever in the switch fully open position. The target 73 is connected to the operating lever 50 and has an arcuate portion 167 bearing an arrangement of the colors green, yellow and red. These colors are alternately visible through a circular opening 171 in the front wall 81 of the housing (FIG. 1) with the colors indicating the true open or closed condition of the operating lever 50 and, therefore, the true open or closed condition of the switch contacts. A link 173 extends between the follower 55 and the switch open latch 63 to move the latch between its open and closed positions as the follower moves between its open and closed positions. A lever 174 is pivotally mounted on the shaft 53 at the follower arm 97 and is pivotally attached at its lower end to the link 173. The lever 174 is pushed in a counterclockwise direction by a roll pin 175 carried between the arms 97 when the follower rotates to its switch contact closed position (see FIG. 8). In other positions of the follower 55, the lever 174 hangs free from the shaft 53. A spring 177 telescopes over the link 173 to bias the latch to its closed position by engaging a pin 179 extending laterally through the link. The opposite end of the link 173 is connected to a second link 181 which connects to the armature 183 of the solenoid 75. The solenoid 75 is mounted on the end wall 87 of the housing. When the solenoid 75 is installed, the roll pin 175 is removed from the arms 97 so that movement of the link 173 is controlled only by the solenoid 75.

To prevent useless energization of the trip solenoid 67 when the switch contacts are open, an auxiliary switch 191 is provided in a circuit which energizes the trip solenoid 67. This switch has an actuating arm 193 with a roller 195 on the arm which engages one of the follower arms 97 to open the trip coil circuit when the follower 55 moves to its switch contact open position.

If for some reason during the opening of the switch contacts after operation of the trip lever 65 or trip solenoid 67 the operating lever 50 and follower 55 fail to move to their switch contact fully open position, the operating handle 51 can be used to force these two members to their open positions, thereby breaking any welding of contacts or other malfunction that would prevent opening of the switch contacts. This is accomplished through a tab 197 formed on the follower arm **99*b* which is engaged by operating handle arm 109 during clockwise rotation of the handle 51** to its switch open position.

To close the switch, the operating handle 51 is rotated counterclockwise from the horizontal open position of the switch contacts to the vertical closed position of the switch contacts. The switch closing latch 61 engages the post 105 on the follower 55 causing it to rotate with the handle. As the follower rotates, so does the shaft 53 and the arbor plates 103 connected to the hook 121 on the inner end of spiral closing spring 57. While the follower 55 is rotating in a counterclockwise direction, the operating lever 50 is held in its open position by the switch open latch 63. Also, as the follower rotates, the coiled spring opening mechanism 59 is raised to its near-toggle position, compressing the coil spring 141. At the same time the follower arm 99 is rotating counterclockwise allowing the operating handle latch 71 to move into position where it engages the post 120 on the operating handle arm 109 to lock the follower 55 in its upright position. The follower arm 97 also moves out of contact with the roller 195 allowing the auxiliary switch 191 to close and reactivate the circuit for trip solenoid 67. The roll pin 175 carried by arms 97 contacts lever 174 which is connected to link 173 causing link 173 to move horizontally to release the switch open latch 63, allowing the operating lever 50 to rotate counterclockwise under the spring pressure of spiral closing spring 57 to quickly move the switch contacts to their closed positions. Thus, it can be seen that the rotating movement of the operating lever 50 and the switch contacts in the closing sequence is completely independent of the rate of rotation of the operating handle 51 but is controlled entirely by the pressure exerted by the spiral closing spring 57.

Figure 11:
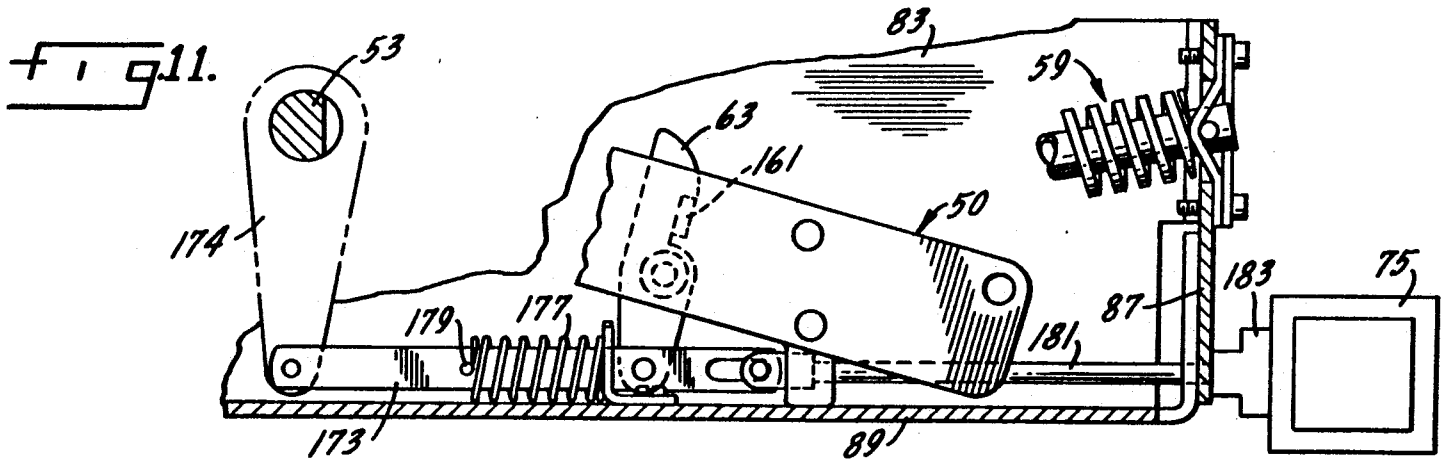
FIG. 11 is a front elevational view similar to FIG. 3 showing a modified form of the switch operating mechanism.

In a variation of the above construction, shown in FIG. 11 of the drawings, the roll pin 175 is removed from the arms 97 allowing the follower lever 174 to be non-responsive to rotation of arms 97 so that movement of the operating link 173 is controlled entirely by movement of the solenoid 75. Closing spring pressure is built up in the spiral spring 57 in the manner previously described, but the switch contacts are not closed until the solenoid 75 is actuated to release the switch open latch 63, thus allowing the operating lever 50 to close.

We claim:

1. A trip-free operating mechanism for a load break switch of the type having a fixed contact engageable by a movable contact operable between a fully closed position and a fully open position, said operating mechanism including:

a shaft, an operating lever adapted to be connected to said movable contact and rotatable about said shaft between a first position established when the movable contact is in its fully closed position and a second position established when the movable contact is in its fully open position, a follower mounted for rotation with said shaft into and out of contact with said operating lever and rotatable from adjacent said first position of said operating lever to adjacent said second position of said operating lever, a closing spring biasing said operating lever and said follower for rotation towards each other, an opening spring drive means connected to said follower to drive said follower and said operating lever to said second position of said operating lever, first latch means for releasably holding said operating lever and said follower apart against the biasing force of said closing spring when said operating lever is in said first position, and trip means for releasing said first latch means to allow said closing spring to rotate said follower into engagement with said operating lever and said opening spring means drive to quickly drive said operating lever to its second position.

2. The trip-free operating mechanism of claim 1 in which said opening spring drive means is connected to said follower in a near-toggle position when said follower is adjacent said first position of said operating lever and in which said opening spring drive means is moved toward an operating lever driving position upon the rotation of said follower into engagement with said operating lever by said closing spring.

3. The trip-free operating mechanism of claim 1 in which an operating handle is mounted for rotation about said shaft between a fully closed position and a fully open position of said movable contact, including second latch means, to retain said operating handle in said fully closed position until said closing spring rotates said follower into engagement with said operating lever, and means to move said operating handle to said fully open position when said follower rotates to a position adjacent said second position of said operating lever.

4. The trip-free operating mechanism of claim 3 in which said first latch mechanism is pivotally mounted on said operating handle and is spring biased into pulling engagement with said follower when said operating handle is rotated from said fully open position to said fully closed position of said movable contact.

5. The trip-free operating mechanism of claim 3 including means associated with said operating handle to engage said follower during rotation of said operating handle from said fully closed to said fully open positions of said movable contact in the event said follower has not been rotated to adjacent said second position of said operating lever by said opening spring drive means.

6. A trip-free operating mechanism for a load break switch of the type having a fixed contact engageable by a movable contact operable between a fully closed position and a fully open position, said operating mechanism including:

a shaft, an operating lever adapted to be connected to said movable contact and rotatable about said shaft between a first position established when the movable contact is in its fully closed position and a second position established when the movable contact is in its fully open position, a follower mounted for rotation with said shaft into and out of contact with said operating lever and rotatable from adjacent said first position of said operating lever to adjacent said second position of said operating lever, a closing spring biasing said operating lever and said follower for rotation towards each other, an opening spring drive means connected to said follower to drive said follower and said operating lever to said second position of said operating lever, an operating handle mounted for rotation about said shaft between a fully closed position and a fully open position of said movable contact, latch means to cause said follower to rotate with said operating handle from said fully open position towards said fully closed position of said movable contact to thereby energize said closing spring, means to restrain said operating lever in said second position as said follower is rotated with said operating handle towards said fully closed position of said movable contact, and means to release said operating lever to allow it to rotate to said first position under the influence of said closing spring.

7. The trip-free operating mechanism of claim 6 in which said means to release said operating lever to allow it to rotate to said first position under the influence of said closing spring includes pin means on said follower and link means attached to said restrain means with said pin means engaging said link means to pivot said restrain means.

8. The trip-free operating mechanism of claim 6 in which said means to release said operating lever to allow it to rotate to said first position under the influence of said closing spring includes a link means attached to said restrain means and a solenoid connected to said link means.

* * * * *